US010675877B2

(12) United States Patent
Murakami et al.

(10) Patent No.: US 10,675,877 B2
(45) Date of Patent: Jun. 9, 2020

(54) INK CARTRIDGE

(71) Applicant: CANON KABUSHIKI KAISHA, Tokyo (JP)

(72) Inventors: Hironori Murakami, Tokyo (JP); Yasuo Kotaki, Yokohama (JP); Tetsuya Ohashi, Matsudo (JP); Ryoji Inoue, Kawasaki (JP); Takashi Fukushima, Yokohama (JP); Kyosuke Nagaoka, Kodaira (JP); Takeho Miyashita, Yokohama (JP); Kenichi Kanno, Fukushima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/250,965

(22) Filed: Jan. 17, 2019

(65) Prior Publication Data

US 2019/0224979 A1 Jul. 25, 2019

(30) Foreign Application Priority Data

Jan. 22, 2018 (JP) ..... 2018-008172

(51) Int. Cl.
*B41J 2/175* (2006.01)

(52) U.S. Cl.
CPC ..... *B41J 2/17513* (2013.01); *B41J 2/175* (2013.01); *B41J 2/1752* (2013.01); *B41J 2/17523* (2013.01); *B41J 2/17553* (2013.01); *B41J 2/17556* (2013.01); *B41J 2202/12* (2013.01)

(58) Field of Classification Search
CPC ..... B41J 2/17513; B41J 2/175; B41J 2/1752; B41J 2/17523; B41J 2/1572; B41J 2/17553; B41J 2/17556
See application file for complete search history.

(56) References Cited

U.S. PATENT DOCUMENTS

2015/0258802 A1* 9/2015 Ishizawa ..... B41J 2/17513 347/86

FOREIGN PATENT DOCUMENTS

JP 2005-186600 A 7/2005

* cited by examiner

*Primary Examiner* — Jason S Uhlenhake
(74) *Attorney, Agent, or Firm* — Canon U.S.A., Inc. I.P. Division

(57) ABSTRACT

Provided is an ink cartridge having an ink storage portion for storing an ink therein and a plurality of flow paths for supplying the ink to the outside of the ink cartridge. In the ink cartridge, the plurality of flow paths each has a bottom flow path having a bottom opening in a vertically lower direction in the ink storage portion during use of the ink cartridge and a top flow path having a top opening in a vertically upper direction in the ink storage portion than the bottom flow path during use of the ink cartridge; the bottom flow path has a resistance different from that of the top flow path; and air is not introduced into the ink storage portion when the ink is supplied from the bottom flow path and the top flow path.

16 Claims, 7 Drawing Sheets

INK CARTRIDGE

BACKGROUND OF THE INVENTION

Field of the Invention

The present disclosure relates to an ink cartridge.

Description of the Related Art

An ink jet printer, as one example of a recording apparatus carries out recording by being equipped with an ink cartridge having an ink therein, being supplied with the ink from the ink cartridge, and then ejecting the ink to a recording medium such as paper. The ink cartridge is accompanied with the drawback that due to precipitation of an ink component (particularly, a pigment) in an ink storage portion in which an ink is stored, a high-concentrated ink is supplied first, followed by supply of a low-concentrated ink. Variation in concentration of an ink to be supplied leads to deterioration in recording quality.

With a view to overcoming such a problem, Japanese Patent Application Laid-Open No. 2005-186600 describes an ink cartridge in which a plurality of ink storage portions is communicated by a plurality of flow paths different in flow resistance to cause an ink flow and thereby stirs an ink.

In the ink cartridge described in Japanese Patent Application Laid-Open No. 2005-186600, the ink storage portion is introduced with air. In the case where the ink storage portion is introduced with air, any of the flow paths different in flow resistance cannot be used with a decrease in the amount of an ink stored in the ink storage portion, making it difficult to cause an ink flow for stirring. As a result, deterioration in recording quality occurs.

SUMMARY OF THE INVENTION

In the present disclosure, there is provided an ink cartridge including an ink storage portion for storing an ink therein and a plurality of flow paths for supplying the ink outside the ink cartridge from the ink storage portion. This ink cartridge is characterized by that a plurality of the flow paths include a bottom flow path which has a bottom opening in a vertically lower direction in the ink storage portion during use of the ink cartridge and a top flow path having a top opening in a vertically upper direction in the ink storage portion than the bottom flow path during use of the ink cartridge; the bottom flow path has resistance different from that of the top flow path; and air is not introduced into the ink storage portion upon supplying the ink from the bottom flow path and the top flow path.

Further features of the present disclosure will become apparent from the following description of exemplary embodiments with reference to the attached drawings.

DESCRIPTION OF THE EMBODIMENTS

An aspect of the disclosure is therefore to provide an ink cartridge that does not easily cause deterioration in recording quality even if an amount of an ink stored therein decreases.

The ink cartridge of the disclosure will hereinafter be described specifically while referring to some drawings. The embodiments described below are preferable examples for carrying out the disclosure and the disclosure is not limited by these constitutions. Some of the details described in the embodiments can be used in combination.

First Embodiment

<Recording Apparatus>

Figure 1:
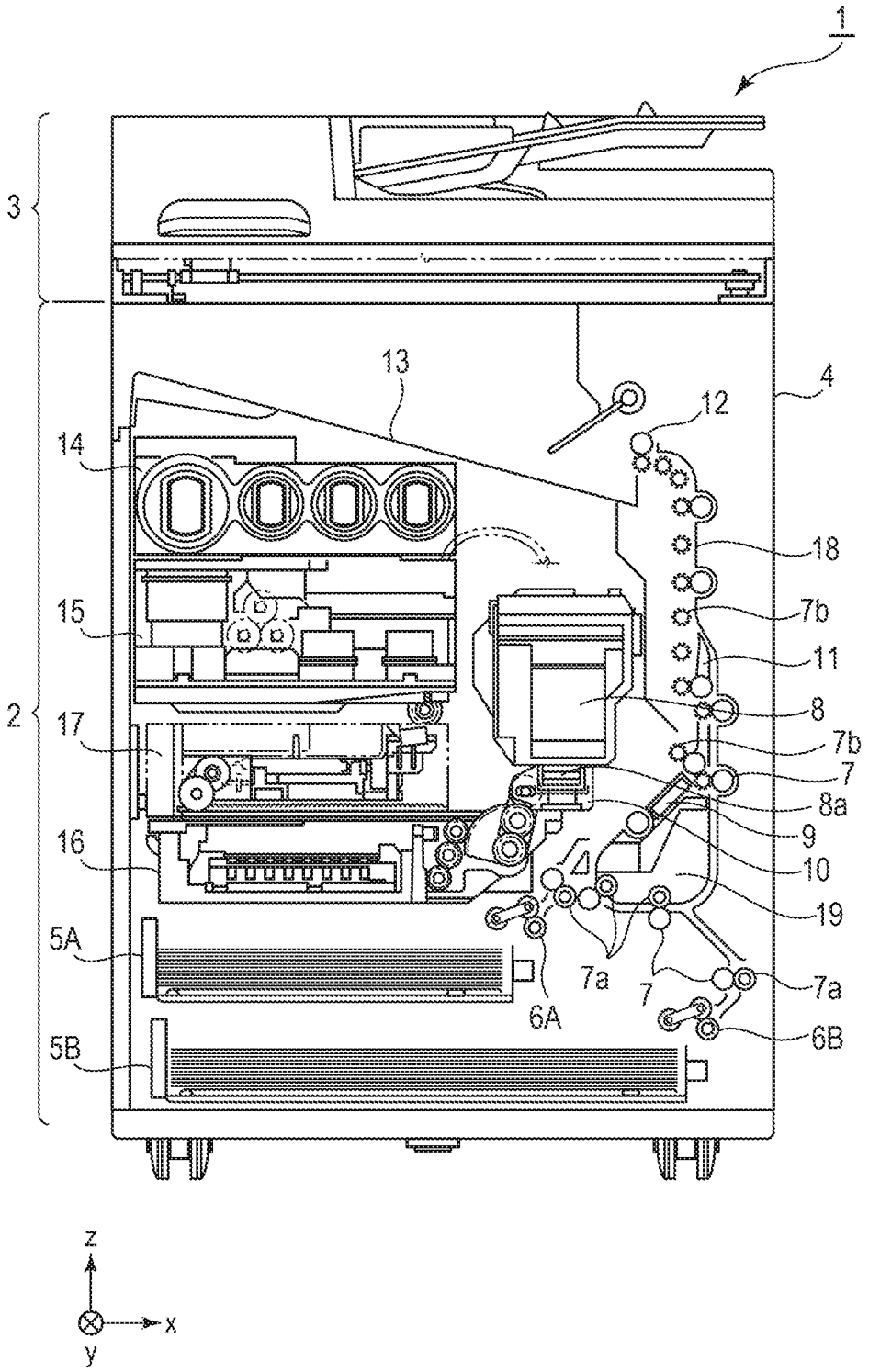
FIG. 1 shows the constitution of an ink jet printer.

The entire constitution of an ink jet printer 1 (which will hereinafter be called "recording apparatus 1") which is one example of a recording apparatus to be equipped with the ink cartridge of the disclosure will be described referring to FIG. 1. FIG. 1 shows the internal constitution of the recording apparatus 1. In FIG. 1, an x direction is a horizontal direction, a y direction (perpendicular direction on the page) is a direction along which ejection orifices are arranged in a recording head 8 and a z direction is a vertical (gravity) direction. The x direction, the y direction and the z direction shown in FIG. 1 have the same meanings in the drawings after FIG. 1. For example, the x direction, the y direction and the z direction shown in FIGS. 2A and 2B coincide with the x direction, the y direction and the z direction shown in FIG. 1, respectively.

The recording apparatus 1 is a complex apparatus having a print unit 2 and a scanner unit 3 above the print unit 2 and can carry out various processings relating to a recording operation and a reading operation by driving the print unit 2 and the scanner unit 3 individually or driving them in connection. The scanner unit 3 is equipped with ADF (auto document feeder) and FBS (flat bed scanner) and can read a manuscript fed automatically at ADF and read (scan) a manuscript placed by a user on a manuscript table of FBS. The apparatus of the present embodiment is a complex apparatus having both the print unit 2 and the scanner unit 3, but it does not necessarily have the scanner unit 3. FIG. 1 shows the recording apparatus 1 in a stand-by state, meaning that it starts neither a recording operation nor a reading operation.

In the print unit 2, a first cassette 5A and a second cassette 5B for storing a recording medium (cut sheet) S therein are detachably installed at the vertically lower bottom of a housing 4. The first cassette 5A has therein flatly stacked recording media of a relatively small size up to A4 size and the second cassette 5B has therein flatly stacked recording media of a relatively large size up to A3 size. The first cassette 5A has, in the vicinity thereof, a first feed unit 6A for separating the stored recording media and feeding them one by one. Similarly, the second cassette 5B has, in the vicinity thereof, a second feed unit 6B. When the recording operation is performed, the recording medium S is fed selectively from either one of these cassettes.

A conveying roller 7, a discharge roller 12, a pinch roller 7*a*, a spur 7*b*, a guide 18, an inner guide 19 and a flapper 11 constitute a conveying mechanism for introducing the recording medium S in a predetermined direction. The conveying roller 7 is a driving roller placed on the upstream side and the downstream side of the recording head 8 and driven by an unillustrated conveying motor. The pinch roller 7*a* is a driven roller which rotates together with the conveying roller 7 while nipping the recording medium S. The discharge roller 12 is a driving roller placed on the downstream side of the conveying roller 7 and is driven by an unillustrated conveying motor. The spur 7*b* conveys the recording medium S while sandwiching it with the conveying roller 7 and the discharge roller 12 placed on the downstream side of the recording head 8.

The guide 18 provided in a conveying path of the recording medium S guides the recording medium S in a predetermined direction. The inner guide 19 extends in the y direction, has a curved side surface and guides the recording medium S along the side surface. The flapper 11 serves to switch the conveying direction of the recording medium S during a duplex recording operation. A discharge tray 13 is a tray for stacking and holding the recording medium S discharged by the discharge roller 12 after completion of the recording operation.

The recording head 8 of the present embodiment is a full-line type color ink jet recording head and it has a plurality of ejection orifices for ejecting an ink according to recording data. The ejection orifices are arranged along the y direction of FIG. 1 so as to correspond to the width of the recording medium S. When the recording head 8 is at a stand-by position, an ejection orifice surface 8*a* of the recording head 8 is capped by a cap unit 10 as shown in FIG. 1. When the recording operation is performed, the direction of the recording head 8 is changed by a print controller so that the ejection orifice surface 8*a* faces to a platen 9. The platen 9 consists of a flat plate extending in the y direction and supports the recording medium S, which is subjected to a recording operation by the recording head 8, from the back side thereof.

The recording head 8 is not necessarily a full-line type recording head and it may be a serial scan type recording head to be reciprocated in a direction crossing the conveying direction of the recording medium S.

An installation unit 14 is a unit in which the ink cartridge is installed. The installation unit 14 may be a unit removable from the recording apparatus 1. In the example shown here, four ink cartridges are installed in the installation unit 14 and the ink cartridges may each store any one of four inks to be supplied to the recording head 8. An ink supply unit 15 is provided midway of a flow path connecting between the installation unit 14 and the recording head 8 and adjusts the pressure and the flow rate of the ink in the recording head 8 to fall within an adequate range. The present embodiment adopts a circulation type ink supply system and the ink supply unit 15 adjusts the pressure of the ink supplied to the recording head 8 and the flow rate of the ink collected from the recording head 8 to fall within adequate ranges, respectively.

A maintenance unit 16 is equipped with a cap unit 10 and a wiping unit 17 and it performs a maintenance operation for the recording head 8 by driving them at a predetermined timing.

The term "ink" as used herein means any liquid to be added to a recording medium for the formation of an image or processing of the recording medium. The term "ink" as used herein is a concept embracing any liquid capable of being used for recording. The concept of recording is not particularly limited and can be used also for industrial applications. For example, it can also be used for fabrication of a biochip, printing of an electronic circuit, manufacture of a semiconductor substrate, and the like. A container for storing these inks is an ink cartridge.

Figure 2A:
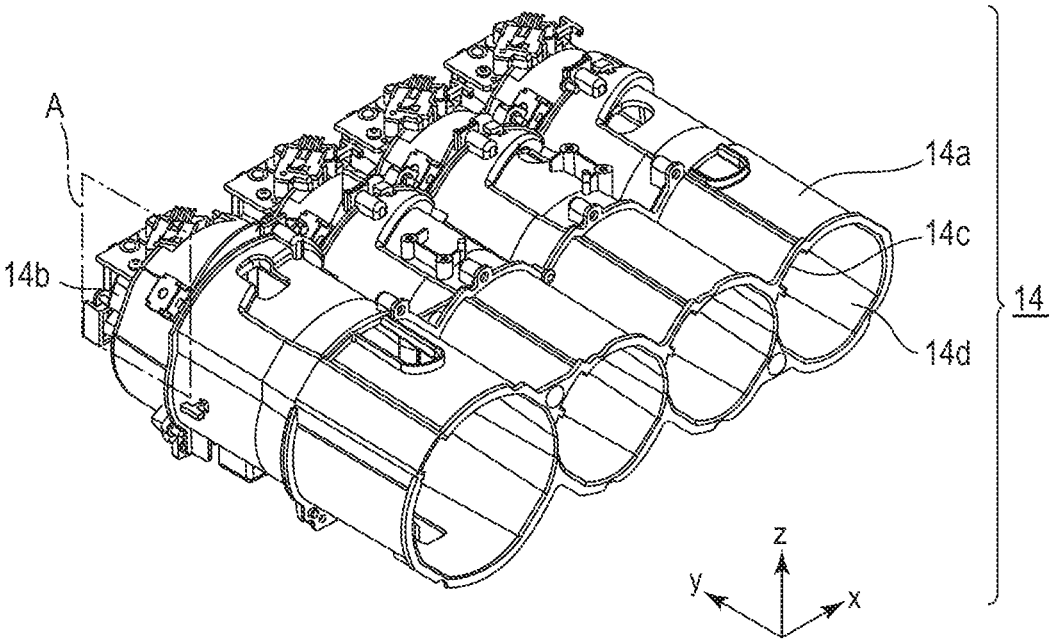
FIGS. 2A and 2B show the constitution of an ink cartridge.
Figure 2B:
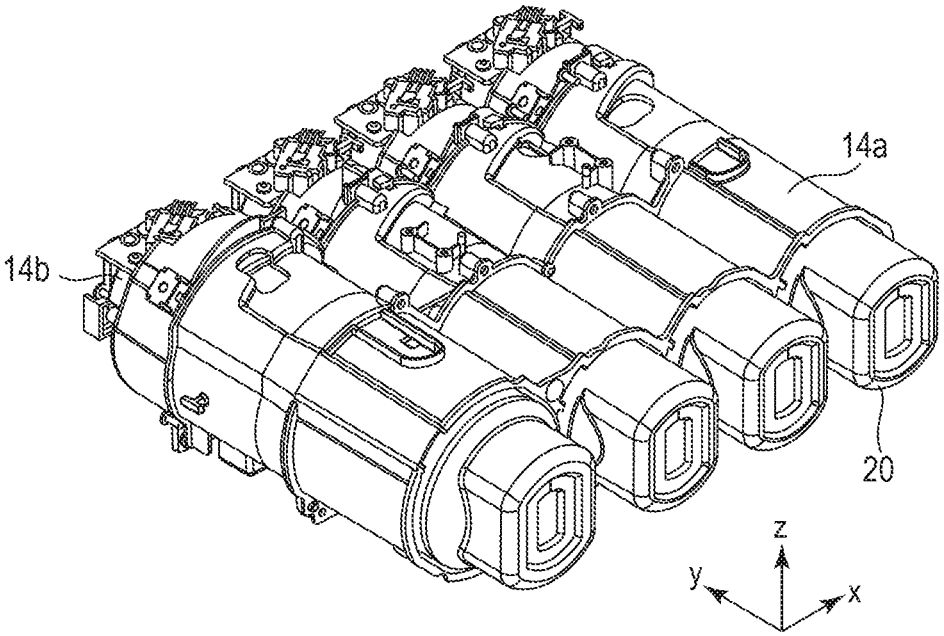

FIGS. 2A and 2B show the installation unit 14 taken out from the recording apparatus of FIG. 1 and viewed from obliquely above relative to the vertical direction. FIG. 2A shows the installation unit 14 before the ink cartridge is installed therein and FIG. 2B shows the installation unit 14 after the ink cartridge 20 is installed therein.

The installation unit 14 shown in FIG. 2A has four cylindrical hole forming members 14*a*. The hole forming members 14*a* form holes 14*d* respectively. The ink cartridge 20 is installed in the installation unit 14 of the recording apparatus by being inserted into the holes 14*d* formed by the hole forming members 14*a* of the installation unit 14. It is not always necessary to provide a plurality of the hole forming members 14*a*. For example, one hole forming member forms a plurality of holes. The hole 14*d* has preferably a diameter (diameter in a direction orthogonal to the extending direction of the hole 14*d*) of 50 mm or more to 90 mm or less. When the diameter of the hole 14*d* in a direction orthogonal to its extending direction is not a diameter of a true circle, an equivalent circle diameter is regarded as the diameter of the hole 14*d*.

The hole forming member 14*a* has, at the back side thereof, a hole forming member 14*b* different from the hole forming member 14*a*. When the ink cartridge is installed, the hole forming member 14*a* is placed on the front side and the hole forming member 14*b* is placed on the back side. The hole forming member 14*b* also has a hole (not shown in FIGS. 2A and 2B) and the hole 14*d* of the hole forming member 14*a* is communicated with the hole of the hole forming member 14*b* inside the installation unit 14. The ink cartridge 20 is inserted into this communicated hole. The hole forming member 14*a* and the hole forming member 14*b* are not necessarily provided as separate members. For example, these two hole forming members may be united into one member. Examples of a material of the hole forming member 14*a* include ABS (acrylonitrile-butadiene-styrene copolymer resin), PPO (polyphenylene oxide, noryl), and HIPS (high-impact polystyrene resin). Examples of a material of the hole forming member 14*b* include PP (polyethylene) and PPO.

The hole forming member 14*a* has, in an opening on the front side of its hole 14*d*, an ID recess 14*c*. The ID recess 14*c* is used for rough alignment of the ink cartridge 20 with the installation unit 14 when the ink cartridge 20 is installed. In FIGS. 2A and 2B, the ID recess 14*c* having a recessed shape is formed by partially denting the round opening of the hole 14*d*.

The installation unit 14 further has a plurality of electrical connection units (not shown in FIGS. 2A and 2B) which are brought into contact with a plurality of pad electrodes which the ink cartridge has and become electrically connectable with the pad electrodes by this contact. In FIGS. 2A and 2B, the hole forming member 14*b* of the installation unit 14 has the electrical connection units.

Figure 3:
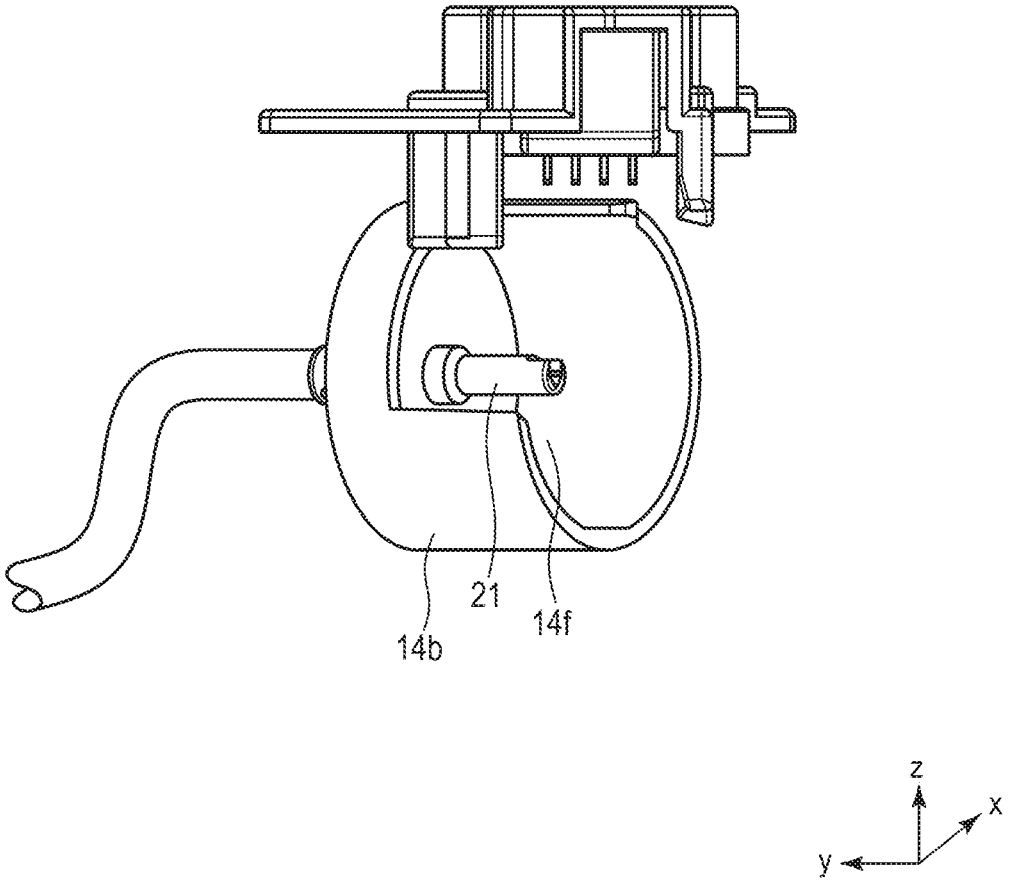
FIG. 3 shows the constitution of the ink cartridge.

FIG. 3 is an enlarged schematic view of the vicinity of the electrical connection unit which the hole forming member 14*b* of the installation unit 14 has. FIG. 3 shows the cross-section of the installation unit 14 in a portion surrounded with A in FIG. 2A. From FIG. 3, the installation unit 14 including the hole forming member 14*a* is partially omitted. As shown in FIG. 3, the hole forming member 14*b* forms a hole 14*f* From the surface on the back side of the hole 14*f* (the bottom surface of the hole 14*f* formed by the hole forming member 14*b*), an ink receiving tube 21 in tubular form protrudes. The surface on the back side of the hole 14*f* is circular and from the center of this circle, the ink receiving tube 21 protrudes in a direction (extending direction) perpendicular to the surface on the back side of the hole 14*f* The ink receiving tube 21 is a tube that receives an ink supplied from the ink cartridge installed in the installation unit 14. The ink receiving tube 21 is connected with the recording head of the recording apparatus via an ink flow path and supplies the recording head with the ink received from the ink cartridge. One ink receiving tube corresponds to an ink of one color. It is therefore preferred to provide the number of ink receiving tubes corresponding to the number of ink colors used. Examples of a material forming the ink receiving tube 21 include SUS (stainless) and PPO. The diameter (diameter in the cross-section orthogonal to the extending direction of the ink receiving tube) of the ink receiving tube 21 is preferably 2 mm or more to 5 mm or less, more preferably 3 mm or more to 4 mm or less. The diameter of the hole 14*f* (diameter in a direction orthogonal to the extending direction of the hole 140 is preferably 20 mm or more to 30 mm or less. The diameter of the hole 14*f* is preferably smaller than the diameter of the hole 14*d* and it is more preferably 40% or more to 50% or less of the diameter of the hole 14*d*.

<Ink Cartridge>

FIGS. 4A, 4B, 4C and 4D show the appearance of the ink cartridge from various angles. The ink cartridge 20 shown in FIGS. 4A, 4B, 4C and 4D has a columnar (cylindrical) housing as a base. The housing has not only a columnar shape but also, for example, a polygonal prism shape such as triangular prism or quadrangular prism shape. It may also have a conical shape or a polygonal pyramid shape such as triangular pyramid or quadrangular pyramid shape.

Figure 4A:
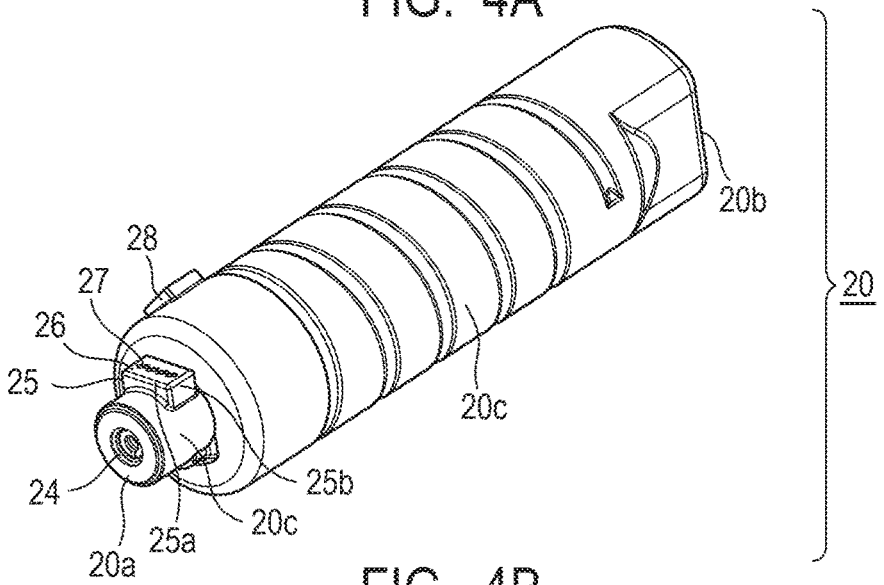
FIGS. 4A, 4B, 4C and 4D show the constitution of the ink cartridge.
Figure 4B:
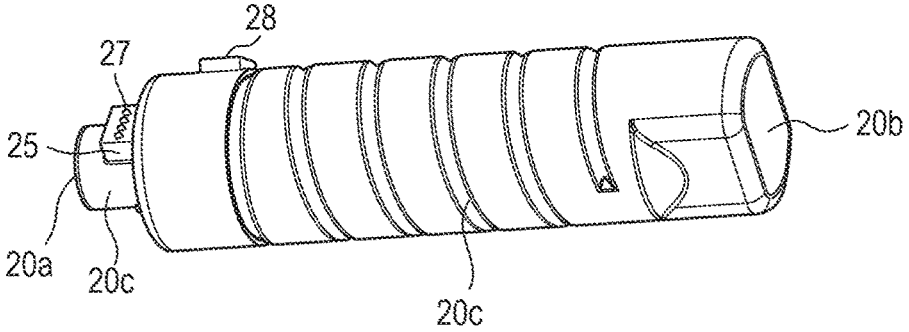
Figure 4C:
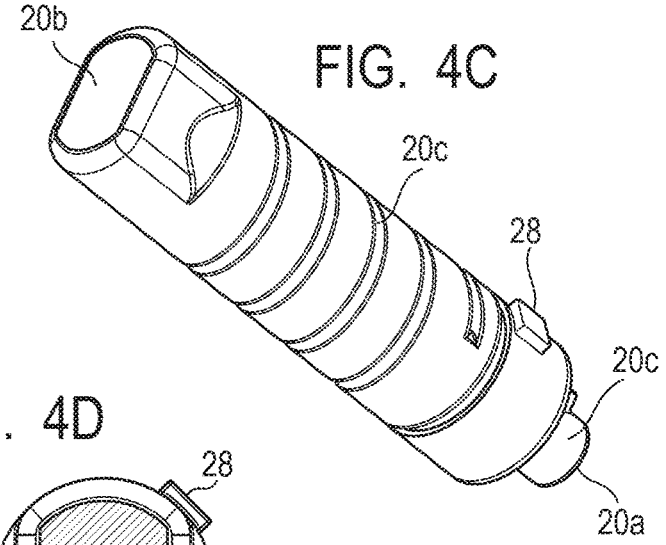
Figure 4D:
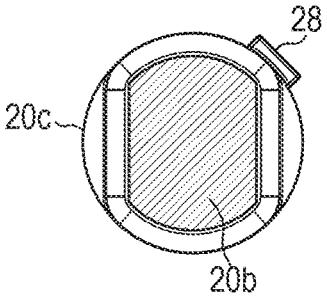

The ink cartridge 20 has, as a portion adjacent to the outside of the ink cartridge 20, at least a first portion 20*a*, a second portion 20*b* and a third portion 20*c*. A portion having an insertion portion 24 is the first portion 20*a*. A portion on the side opposite to this first portion 20*a* is the second portion 20*b*. The first portion 20*a* and the second portion 20*b* are connected by the third portion 20*c*. The third portion 20*c* lies between the first portion 20*a* and the second portion 20*b* and in FIGS. 4A, 4B and 4C, the third portion 20*c* is orthogonal to the first portion 20*a* and the second portion 20*b*. The first portion 20*a*, the second portion 20*b* and the third portion 20*c*, may be, as shown in FIGS. 4A, 4B and 4C, a plane. Alternatively, at least one of the first portion 20*a*, the second portion 20*b* and the third portion 20*c* may not be a plane. For example, when the ink cartridge 20 is a triangular pyramid shape, the first portion 20*a* may be the base of the triangular pyramid shape, the second portion 20*b* is an apex on the base of the triangular pyramid shape, and the third portion 20*c* may be a side plane of the triangular pyramid shape. In this case, the second portion 20*b* is an apex but not a plane.

The first portion 20*a* has the insertion portion 24 into which the ink receiving tube 21 shown in FIG. 3 and the like is inserted. The first portion 20*a* can therefore be regarded as a front portion of the housing. In FIGS. 4A, 4B and 4C, the first portion 20*a* is a plane. The insertion portion 24 is provided with a seal member having an opening, which will be described later. The ink receiver tube is inserted into an opening which the seal member of the insertion portion 24 has. The diameter of the insertion portion (diameter in a direction orthogonal to an inserting direction of the ink receiving tube) is preferably 2 mm or more to 5 mm or less.

The ink cartridge 20 stores therein an ink. The ink thus stored is supplied to the recording apparatus through the ink receiving tube inserted into the insertion portion 24 (an opening of the seal member if it has the seal member) and used for recording.

The ink cartridge 20 consists of a large diameter portion having a relatively large diameter and a small diameter portion having a diameter relatively smaller than that of the large diameter portion. The ink cartridge shown in FIGS. 4A, 4B, 4C and 4D has a cylindrical shape. The term "diameter" as used herein means a diameter of a circle in a cross-section along a direction perpendicular to the height direction of the cylinder. The small diameter portion having the insertion portion 24 is the first portion 20*a*. The second portion 20*b* is provided in the large diameter portion. The third portion 20*c* connecting between the first portion 20*a* and the second portion 20*b* is a plane extending over the large diameter portion and the small diameter portion and having a step difference therebetween. The ink cartridge 20 may have a fixed diameter and have no step difference in the third portion 20*c*. The ink cartridge 20 shown in FIGS. 4A, 4B, 4C and 4D has a cylindrical shape. The first portion 20*a* and the second portion 20*b* are bases of a cylinder and the third portion 20C is a side surface of the cylinder. As described above, the shape of the ink cartridge 20 is not limited to a cylinder. The first portion 20*a* or second portion 20*b* may have a step difference.

The large diameter portion of the ink cartridge 20 preferably has a diameter of 50 mm or more to 80 mm or less. The small diameter portion of the ink cartridge 20 preferably has a diameter of 20 mm or more to 30 mm or less. The ink cartridge 20 can have a different diameter, depending on the amount or kind of the ink to be stored therein. For example, in a certain ink cartridge set, the diameter of the large diameter portion of a large-capacity ink cartridge can be adjusted to 70 mm or more to 80 mm or less and the diameter of the large diameter portion of a small-capacity ink cartridge can be adjusted to 50 mm or more to 60 mm or less. Even in such a case, the small diameter portions preferably have the same diameter between the ink cartridges from the standpoint of installation. In other words, in a set of ink cartridges different in the amount or kind of an ink to be stored therein, it is preferred that the respective small diameter portions of the ink cartridges have the same diameter and the large diameter portions have respectively different diameters.

The large diameter portion of the ink cartridge 20 has preferably a length of 190 mm or more to 220 mm or less. The small diameter portion of the ink cartridge 20 has preferably a length of 20 mm or more to 30 mm or less. The length of each of the large diameter portion and the small diameter portion is a length of the ink cartridge 20 in a direction parallel to a direction from the first portion 20*a* to the second portion 20*b*. From the standpoint of installation, the small diameter portion and the large diameter portion of the ink cartridge portion 20 preferably have the same lengths, respectively, even if the amount or kind of an ink to be stored is different as the ink cartridge set described above. The direction from the first portion 20*a* to the second portion 20*b* of the ink cartridge 20 means a direction of the shortest line that couples the first portion 20*a* to the second portion 20*b*. In FIGS. 4A, 4B and 4C, this direction coincides with the longer direction of the ink cartridge.

Next, a projection 25 and an ID projection 28 will be described. The third portion 20*c* is provided with the projection 25 and the ID projection 28. In FIGS. 4A, 4B and 4C, the projection 25 is in the small diameter portion of the third portion 20*c* and it protrudes from the periphery of the projection 25 constituting the third portion 20*c*. The projection 25 has, as the periphery thereof, the side surface of the cylinder and the projection 25 protrudes from the side surface of this cylinder. The projection 25 has a ceiling surface 25*a* which becomes a ceiling of the projection 25 and a projection side surface 25*b*. The projection has four projection side surfaces 25*b*, which are connected at the upper portion, that is, at the ceiling surface 25*a*. The ceiling surface 25*a* has thereabove an electrode portion 26. The electrode portion 26 has thereabove a plurality of pad electrodes 27 which is brought into contact with the electrical connection unit of the recording apparatus (installation unit) to facilitate electrical connection with the electrical connection unit. The ceiling surface 25*a* is a portion adjacent to the outside of the ink cartridge 20 and a part of a portion connecting between the first portion 20*a* and the second portion 20*b* so that it is a part of the third portion 20*c*. This means that the electrode portion 26 or the pad electrodes 27 provided on the ceiling surface 25*a* are provided in the third portion 20*c*. The electrode portion 26 may consist only of the pad electrode 27. In this case, the pad electrode 27 is placed directly on the ceiling surface 25*a* of the projection 25.

The ID projection 28 protrudes from the large diameter portion of the third portion 20*c*. The ID projection 28 also protrudes from the periphery thereof. The ID projection 28 has, around thereof, a cylindrical side surface and the ID projection 28 protrudes form this cylindrical side surface.

Examples of a material forming the housing of the ink cartridge 20, particularly, that on the side of the second portion 20*b*, include PE (polyethylene) and polypropylene (PP). Examples of a material forming the projection 25 include, similar to those of the housing, PE (polyethylene) and PP (polypropylene). Examples of a material forming the electrode portion 26 include a flexible print board made of glass epoxy or polyimide. Examples of a material forming the pad electrode 27 include Ni and Au. Examples of a material forming the ID projection 28 include, similar to those of the housing, PE (polyethylene) and PP (polypropylene).

Figure 5A:
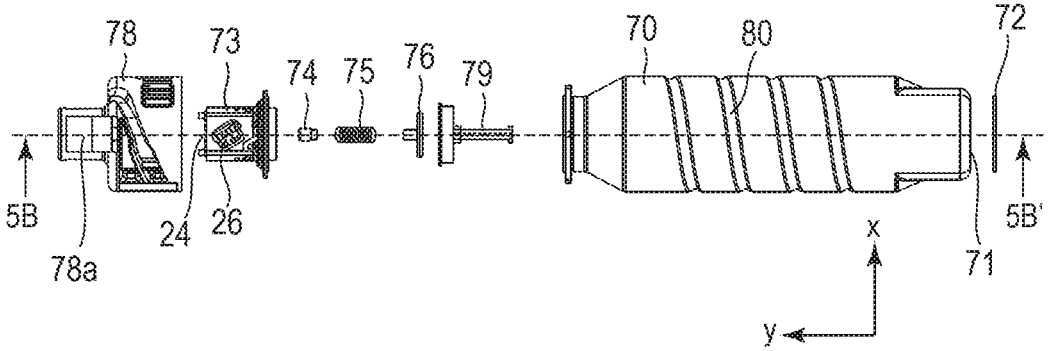
FIGS. 5A, 5B and 5C show the constitution of the ink cartridge.
Figure 5B:
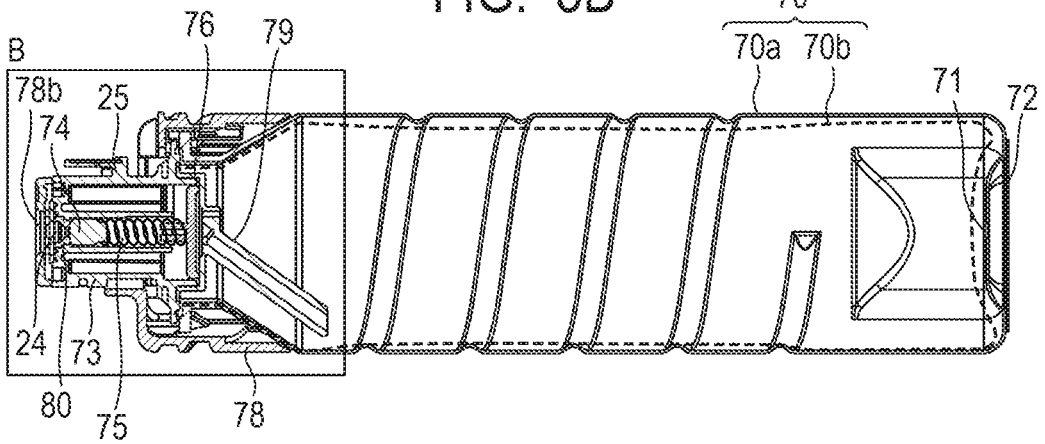

FIGS. 5A and 5B show the internal constitution of the ink cartridge 20. FIG. 5A is a block diagram of the ink cartridge 20 and FIG. 5B is a cross-sectional view taken along the line 5B to 5B' of FIG. 5A after the parts shown in FIG. 5A are assembled. A housing 70 is made of two layers, that is, an outer layer 70*a* and an inner layer 70*b*. The outer layer 70*a* is an outside layer shown by a solid line and is preferably made of a material having high stiffness. On the other hand, the inner layer 70*b* is an inside layer shown by a dotted line and is preferably made of a flexible material. In other words, the outer layer 70*a* preferably has stiffness higher than that of the inner layer 70*b*. The outer layer 70*a* and the inner layer 70*b* can be separated from each other and an ink is stored inside the inner layer 70*b*. This means that the inner layer 70*b* has, inside thereof, an ink storage portion. The outer layer 70*a* and the inner layer 70*b* have an opening at the same portion and a closed space is formed by joining between the opening of the inner layer 70*b* and a joint member 73. An ink is stored in this closed space. The outer layer 70*a* and the inner layer 70*b* are preferably formed by injection blow molding. Examples of a material forming the outer layer 70*a* include PET (polyethylene terephthalate) and PBT (polybutylene terephthalate). Examples of a material forming the inner layer 70*b* include PE (polyethylene) and PP (polypropylene).

The housing 70 is joined with a cover member 78. The housing 70 constitutes a part of the large diameter portion of the ink cartridge. The cover member 78 constitutes a part of the large diameter portion and the small diameter portion of the ink cartridge. The cover member 78 has, at the small diameter portion thereof, an opening 78*b*. Examples of a material forming the cover member 78 include PE, PP and ABS. The cover member 78 has preferably a length of 60 mm or more to 80 mm or less, more preferably 60 mm or more to 70 mm or less. The length of the cover member 78 is a horizontal length of it in FIG. 5A. When the ink cartridge 20 has a shape as shown in FIG. 5A, the length of the cover member 78 is a length of it along the longer direction of the ink cartridge 20.

The housing 70 has, in the outer layer thereof, a screw-like slot 80. The housing 70 provided with the screw-like slot 80 has enhanced strength. The slot 80 may be a single slot or two or more slots not connected to each other. The slot 80 preferably extends in a direction inclined to the longer direction of the ink cartridge from the standpoint of the strength of the housing 70.

The ink cartridge 20 supplies an ink to a member (recording apparatus) outside the ink cartridge 20 and with a decrease in the amount of the ink, the inner layer 70*b* changes its shape according to a decreased volume of the ink. The inner layer 70*b* collapses when the ink stored in the cartridge is used up finally. When the outer layer 70*a* is made of a material having high stiffness, the outer layer 70*a* does not change its shape easily and maintains its shape. In the housing 70, the second portion of the ink cartridge has an air communication port 71 opened therein. From the air communication port 71, air is introduced into a space between the outer layer 70*a* and the inner layer 70*b*. Evaporation of the ink can be suppressed well by covering the air communication port 71 except a small space thereof with a label 72. Examples of a material forming the label 72 include PP film and paper.

The joint member 73 has, at the tip thereof, an insertion portion 24 into which the ink receiving tube is to be inserted. This means that when the ink cartridge has the joint member 73, the joint member 73 constitutes at least a part of the first portion of the ink cartridge. The joint member 73 has a projection 25 and the projection 25 has thereon an electrode portion 26. The joint member 73 is in the cover member 78. The projection 25 is exposed to the outside from the opening 78*a* of the cover member 78 and the insertion portion 24 is exposed to the outside from the opening 78*b* of the cover member 78. In this case, the joint member 73 constitutes a part of the first portion 20*a* and a part of the third portion 20*c* of the ink cartridge.

Figure 5C:
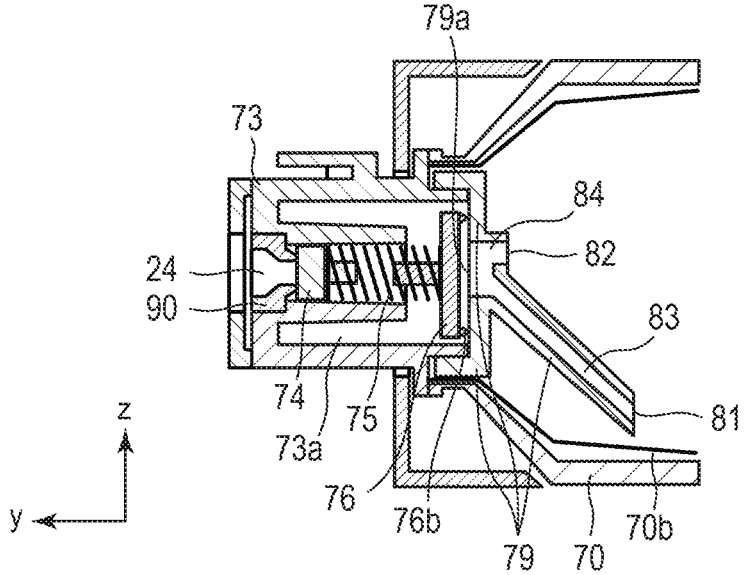

The constitution of the joint member 73 and members therearound will next be described in detail. FIG. 5C is an enlarged view of a portion surrounded with B in FIG. 5B. The joint member 73 has, on the side of the housing 70, a flow path member 79 for supplying an ink from the housing 70 to the joint member 73. The joint member 73 and the flow path member 79 are joined with each other, for example, by press-fit or solvent welding. A space inside of the joint member 73 which space is formed by the joint member 73 and the flow path member 79 is an ink flow path (ink supply portion 73*a*). The joint member 73 and the flow path member 79 have therebetween a flow path opening 79*a* for supplying the ink stored in the housing 70 into the ink supply portion 73*a*. When the ink cartridge is not installed in the recording apparatus, the flow path opening 79*a* is sealed by being pressed against the ink supply portion 73*a* by a second valve 76. As shown in FIG. 5C, the flow path member 79 is provided with a top flow path 84 and a bottom flow path 83 each communicated with the flow path opening 79*a*, which will be described later more specifically.

The insertion portion 24 has an opening. This opening is formed by a seal portion 90. The seal portion 90 may be integrated with the joint member 73 or may be independent from the joint member 73. When the ink cartridge is not installed in the recording apparatus, the opening of the insertion portion 24 is sealed by a first valve 74 pressed against and brought into contact with the seal member 90 by means of a spring 75 which is a pressing member. Examples of a material forming the seal member 90 include rubber and elastomer. Here, a spring is used as the pressing member, but an elastic body such as rubber may be used instead. It is however preferred to use a spring from the standpoint of stability, with use of a spring made of SUS (stainless) being more preferred.

The above-described second valve 76 is placed at an end portion of the spring 75 opposite to an end portion on the opening sealing side of the insertion portion 24, that is, at an end portion on the side of the housing 70. The second valve 76 is, similar to the first valve 74, connected with the spring 75 and is pressed by the spring 75. The second valve 76 has a lip 76*b* at the periphery of a surface opposite to the surface connected with the spring 75 and it is pressed against the flow path member 79 by the spring 75 except during supply of an ink to the recording apparatus. By such a structure, the lip 76*b* comes into contact with a surface 79*d* of the flow path member 79 on the side of the ink supply portion 73*a*, the flow path opening 79*a* of the flow path member 79 on the side of the ink supply portion 73*a* is sealed, and a space between the ink supply portion 73*a* and the housing 70 is closed.

During supply of an ink from the ink cartridge, the ink receiving tube is inserted from the insertion portion 24 into the joint member 73 and the pressure in the joint member 73 is reduced. By this pressure reduction, the second valve 76 which is an air backflow valve is opened. The ink in the housing moves into the joint member 73 via the flow path member 79 and is supplied to the recording apparatus via the ink receiving tube. Examples of a material forming the flow path member 79 include PE (polyethylene) and PP (polypropylene).

As shown in FIG. 5C, the flow path member 79 has a plurality of flow paths. One of the flow paths is a bottom flow path 83 having a bottom opening 81 in a vertically lower direction in the ink storage portion during use of the ink cartridge. The other one is a top flow path 84 having a top opening 82 in a vertically upper direction in the ink storage portion than the bottom opening 81 during use of the ink cartridge. The bottom opening 81 is preferably situated on the side more distant from the insertion portion 24 than the top opening 82. Examples of a material forming the flow path member 79 include PE (polyethylene) and PP (polypropylene).

When a pigment ink containing a pigment is used as the ink, the pigment concentration sometimes increases due to precipitation of the pigment in the vertically lower direction when the ink cartridge 20 is left for a long period of time while being installed in the recording apparatus 1. Under such a condition, when the ink in the ink storage portion is supplied to the recording apparatus through only one flow path, an image thus recorded may have a gradually increased density. In the disclosure, the flow path member 79 has the top flow path 84 having the top opening 82 in the vertically upper direction in the ink storage portion and the bottom flow path 83 having the bottom opening 81 in the vertically lower direction in the ink storage portion than the top flow path 84. The resistance of the bottom flow path 83 is made different from that of the top flow path 84. By supplying the ink from such flow paths, the ink is supplied while reducing a difference in concentration distribution between the vertically upper and lower directions due to precipitation of the pigment or the like.

The resistance of the flow path will be described further. The pigment concentration of an ink layer having a vertical-direction height equal to that of the bottom opening 81 in the ink storage portion during use of the ink cartridge is set at $M_{bottom}$ [mass %]. The pigment concentration of an ink layer having a vertical-direction height equal to that of the top opening 82 in the ink storage portion during use of the ink cartridge is set at $M_{top}$ [mass %]. The pigment concentration of an ink is set at M [mass %] assuming that the pigment is uniformly dispersed in the ink storage portion (which concentration will hereinafter be called "uniform concentration"). The flow resistance of the bottom flow path 83 and the flow resistance of the top flow path 84 are set at $R_{bottom}$ and $R_{top}$, respectively. When their relationship satisfies the following inequalities, an ink having a small difference between uniform concentration and pigment concentration can be sucked up more than an ink having a large difference between uniform concentration and pigment concentration. The pigment concentration is an average of values measured at any 10 positions where the ink is dispersed.

An ink supplied to the recording apparatus 1 can have a more uniform pigment concentration by satisfying the following inequalities: $(M_{bottom}-M)>(M-M_{top})$ and $R_{bottom}>R_{top}$ or $(M_{bottom}-M)<(M-M_{top})$ and $R_{bottom}<R_{top}$.

Further, a resistance ratio of $R_{top}$, to $R_{bottom}$ preferably satisfies the following inequality:

$$0.3<R_{top}/R_{bottom}<4.5.$$

As described above, with a decrease in the amount of an ink stored in the ink storage portion as a result of supply of it to the outside of the ink cartridge 20 (recording apparatus 1), the inner layer 70*b* changes its shape according to a decreased volume of the ink. When the ink stored in the ink storage portion is used up finally, the inner layer 70*b* collapses. On the other hand, the outer layer 70*a* made of a material having high stiffness is hard to change its shape and therefore maintains its shape. An air communication port 71 is opened in the second portion 20*b* of the housing 70 of the ink cartridge. Air is introduced into a space between the outer layer 70*a* and the inner layer 70*b* from the air communication port 71. The ink cartridge 20 of the disclosure has such a shape so that an ink can be supplied without introducing air into the ink storage portion (inside the inner layer). It is therefore possible to supply the ink by preventing the flow paths or openings of the above-described flow paths, to begin with the top flow path 84, from being filled with air. If there is a flow path which has failed to supply the ink and a stored amount of the ink decreases and is almost used up, there occurs variation in a total supply amount of the ink, leading to deterioration in recording quality. The disclosure adopts such a constitution that air is not introduced into the ink storage portion so that the ink can be supplied from all the flow paths and the concentration of the pigment in the ink to be supplied can be made uniform.

Figure 6A:
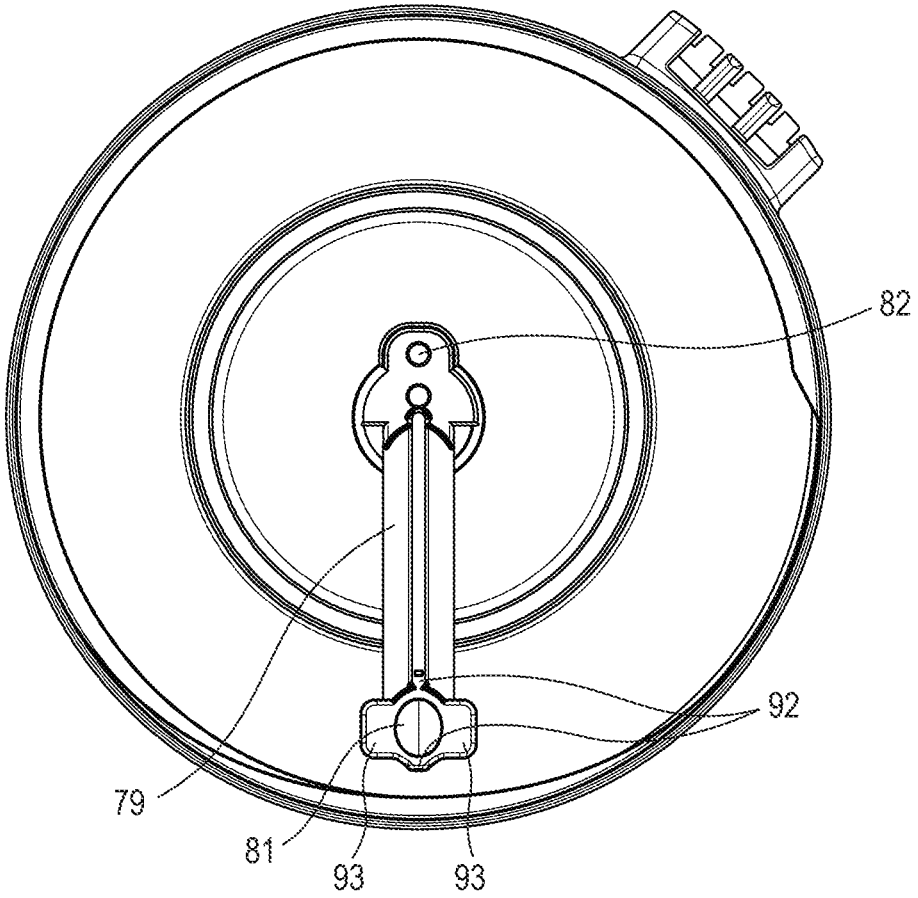
FIGS. 6A and 6B show the constitution of a flow path member.
Figure 6B:
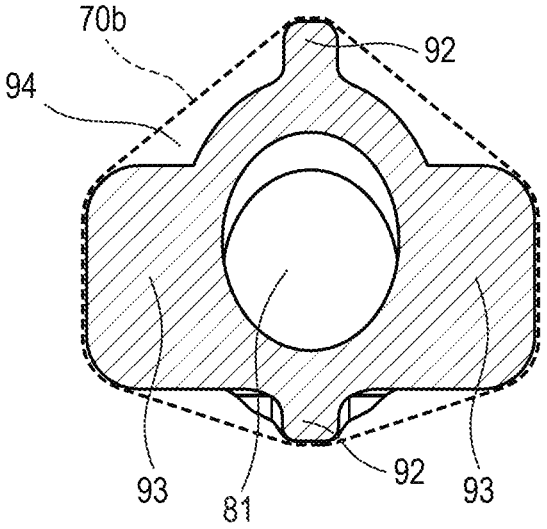

FIGS. 6A and 6B are each an enlarged view of the flow path member 79. FIG. 6A permits viewing of the flow path member 79 inside the ink storage portion from the right side of FIG. 5C. FIG. 6B is an enlarged view of the bottom opening 81 of the flow path member 79 shown in FIG. 6A and the members therearound. When an ink is supplied from the ink cartridge 20 to the recording apparatus 1 and the inner layer 70*b* changes its shape depending on a decreased volume of the ink, the surfaces (inner layer surfaces) facing to each other are presumed to adhere partially. Such adhesion of the inner layer surfaces may prevent supply of an ink, though the ink remains inside of the inner layer 70*b* which is an ink storage portion. To overcome such a problem, it is preferred to provide projections 92 and 93 on the side surface of the flow path member 79 as shown in FIGS. 6A and 6B. By forming the projections 92 and 93 on the side surface of the flow path member 79, a space 94 for supplying the ink to the outside is formed among the side surface of the flow path member 79, the projections 92 and 93 and the inner layer 70*b*. This prevents adhesion of the inner layer surfaces facing to each other and facilitates complete consumption of the ink in the inner layer 70*b*. Both of the projections 92 and 93 are not necessarily provided. In consideration of the release property at the time of injection molding, the number of the projections is preferably 2 or more to 4 or less. The projection preferably protrudes by 1 mm or more to 3 mm or less from the side surface of the flow path member. When the projection has a length less than 1 mm, the inner layer surfaces facing to each other tend to adhere partially, while when the projection is as long as 3 mm or more, the ink easily remains in the space. In addition, the projection preferably has a curved (R shaped) tip so as not to cause breakage of the inner layer 70*b* due to contact with the inner layer surface. The flow path member may have a projection in either the top flow path 84 or the bottom flow path 83, but in order to prevent a problem of ink supply from occurring in the bottom flow path 83, it is preferably provided in at least the bottom flow path 83.

Second Embodiment

A portion of a second embodiment different from the first embodiment will now be described. In the following description, a characteristic part of embodiments will be described mainly and a description on a portion common to them may be omitted.

Figure 7:
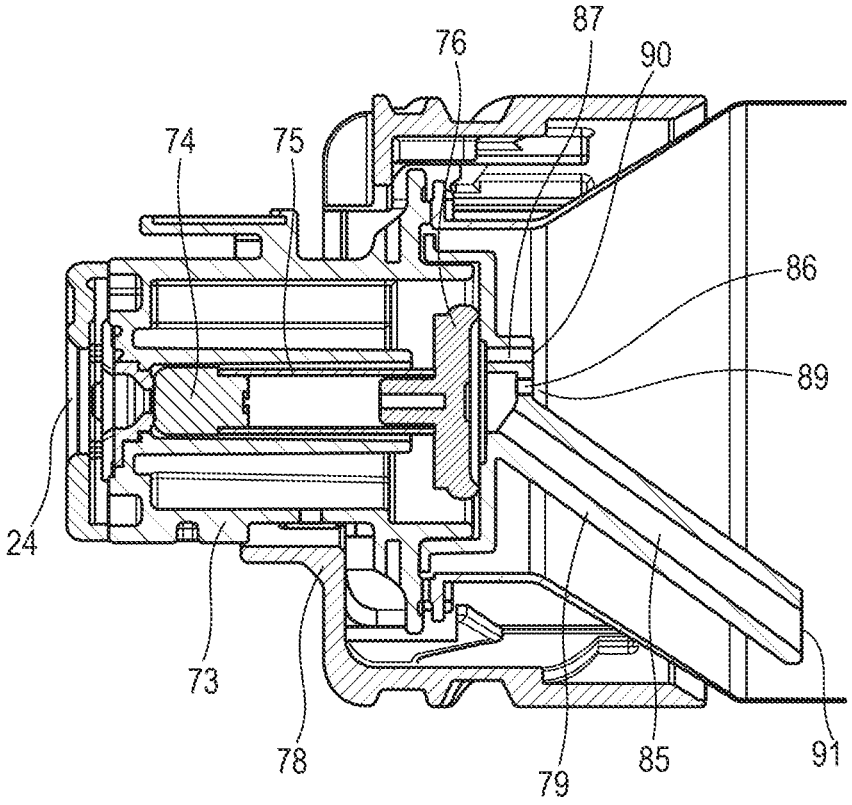
FIG. 7 shows the constitution of an ink cartridge.

In Second Embodiment, the number of flow paths is three as shown in FIG. 7. They are a top flow path 87, a middle flow path 86 and a bottom flow path 85 in a vertically descending order and they have a top opening 90, a middle opening 89 and a bottom opening 91, respectively. The pigment concentration of an ink layer having a vertical-direction height equal to that of the bottom opening 91 in the ink storage portion during use of the ink cartridge is set at $M_{bottom}$[mass %]. Similarly, the pigment concentration of an ink layer having a vertical-direction height equal to that of the middle opening 89 in the ink storage portion during use of the ink cartridge is set at $M_{mid}$[mass %]. Similarly, the pigment concentration of an ink layer having a vertical-direction height equal to that of the top opening 90 in the ink storage portion during use of the ink cartridge is set at $M_{top}$[mass %]. A uniform concentration is set at M [mass %]. The flow resistance of the top flow path 87, the flow resistance of the middle flow path 86 and the flow resistance of the bottom flow path 85 are set at $R_{bottom}$, $R_{mid}$ and $R_{top}$, respectively. The relationship satisfying any one of the following inequalities is preferred, because the pigment concentration of an ink supplied can be made more uniform.

Supposing that $|M_{bottom}-M|>|M_{mid}-M|$, $R_{bottom}>R_{mid}>R_{top}$. Supposing that $|M_{bottom}-M|<|M_{top}-M|<|M_{mid}-M|$, $R_{bottom}>R_{top}>R_{mid}$. Supposing that $|M_{mid}-M|>|M_{bottom}-M|>|M_{top}-M|$, $R_{mi\ d}>R_{bottom}>R_{top}$. Supposing that $|M_{mid}-M|>|M_{top}-M|>|M_{bottom}-M|$, $R_{mid}>R_{top}>R_{bottom}$. Supposing that $|M_{top}-M|>|M_{bottom}-M|>|M_{mid}-M|$, $R_{top}>R_{bottom}>R_{mid}$. Supposing that $|M_{top}-M|>|M_{mid}-M|>|M_{bottom}-M|$, $R_{top}>R_{mid}>R_{bottom}$.

Details of Second Embodiment except the above-described point are similar to those described in First Embodiment.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-008172, filed Jan. 22, 2018, which is hereby incorporated by reference herein in its entirety.

What is claimed is:

1. An ink cartridge comprising an ink storage portion for storing an ink therein and a plurality of flow paths for supplying the ink from the ink storage portion to the outside of the ink cartridge;

the plurality of flow paths each comprising a bottom flow path having a bottom opening in a vertically lower direction in the ink storage portion during use of the ink cartridge and a top flow path having a top opening in a vertically upper direction in the ink storage portion than the bottom flow path during use of the ink cartridge;

wherein the bottom flow path has resistance different from that of the top flow path; and air is not introduced into the ink storage portion at the time when the ink is supplied from the bottom flow path and the top flow path, and wherein the ink cartridge satisfies the following inequalities:

$(M_{bottom}-M)>(M-M_{top})$ and $R_{bottom}>R_{top}$, in which $M_{bottom}$[mass %] means a pigment concentration of a layer of the ink at a position having a vertical-direction height equal to that of the bottom opening in the ink storage portion during use of the ink cartridge; $M_{top}$ [mass %] means a pigment concentration of a layer of the ink at a position having a vertical-direction height equal to that of the top opening in the ink storage portion during use of the ink cartridge; M [mass %] means a pigment concentration of the ink when a pigment is dispersed uniformly in the ink storage portion; $R_{bottom}$ means a flow resistance of the bottom flow path; and $R_{top}$ means a flow resistance of the top flow path.

2. The ink cartridge according to claim 1, wherein the $R_{bottom}$ and the $R_{top}$ satisfy the following inequality:

$0.3<R_{top}/R_{bottom}<4.5$.

3. The ink cartridge according to claim 1, wherein the ink cartridge has an outer layer and an inner layer, a portion inside the inner layer serves as the ink storage portion, and a member constituting the flow path is provided with projections.

4. The ink cartridge according to claim 3, wherein the projections are provided in the bottom flow path.

5. The ink cartridge according to claim 3, wherein the number of the projections is 2 or more to 4 or less.

6. The ink cartridge according to claim 3, wherein the projections each protrude by 1 mm or more to 3 mm or less from a side surface of a flow path member constituting the flow path.

7. The ink cartridge according to claim 3, wherein the projections have a curved tip.

8. The ink cartridge according to claim 1, wherein the flow path has a middle flow path having a middle opening between the bottom opening and the top opening in a vertical direction of the ink storage portion during use of the ink cartridge.

9. An ink cartridge comprising an ink storage portion for storing an ink therein and a plurality of flow paths for supplying the ink from the ink storage portion to the outside of the ink cartridge;

the plurality of flow paths each comprising a bottom flow path having a bottom opening in a vertically lower direction in the ink storage portion during use of the ink cartridge and a top flow path having a top opening in a vertically upper direction in the ink storage portion than the bottom flow path during use of the ink cartridge;

wherein the bottom flow path has resistance different from that of the top flow path; and air is not introduced into the ink storage portion at the time when the ink is supplied from the bottom flow path and the top flow path, and wherein the ink cartridge satisfies the following inequalities:

$(M_{bottom}-M)<(M-M_{top})$ and $R_{bottom}<R_{top}$, in which $M_{bottom}$[mass %] means a pigment concentration of a layer of the ink at a position having a vertical-direction height equal to that of the bottom opening in the ink storage portion during use of the ink cartridge; $M_{top}$ [mass %] means a pigment concentration of a layer of the ink at a position having a vertical-direction height equal to that of the top opening in the ink storage portion during use of the ink cartridge; M [mass %] means a pigment concentration of the ink when a pigment is dispersed uniformly in the ink storage portion; $R_{bottom}$ means a flow resistance of the bottom flow path; and $R_{top}$ means a flow resistance of the top flow path.

10. The ink cartridge according to claim 9, wherein the $R_{bottom}$ and the $R_{top}$ satisfy the following inequality:

$0.3<R_{top}/R_{bottom}<4.5$.

11. The ink cartridge according to claim 9, wherein the ink cartridge has an outer layer and an inner layer, a portion inside the inner layer serves as the ink storage portion, and a member constituting the flow path is provided with projections.

12. The ink cartridge according to claim 11, wherein the projections are provided in the bottom flow path.

13. The ink cartridge according to claim 11, wherein the number of the projections is 2 or more to 4 or less.

14. The ink cartridge according to claim 11, wherein the projections each protrude by 1 mm or more to 3 mm or less from a side surface of a flow path member constituting the flow path.

15. The ink cartridge according to claim 11, wherein the projections have a curved tip.

16. The ink cartridge according to claim 9, wherein the flow path has a middle flow path having a middle opening between the bottom opening and the top opening in a vertical direction of the ink storage portion during use of the ink cartridge.

* * * * *